US006502520B1

(12) United States Patent
Nishi et al.

(10) Patent No.: US 6,502,520 B1
(45) Date of Patent: Jan. 7, 2003

(54) SOLID MATERIAL MELTING APPARATUS

(75) Inventors: Takashi Nishi, Hitachinaka; Hideo Hashida, Shimotsuga-gun; Toshiaki Matsuo, Hitachi; Takeyuki Kondo, Hitachi; Masami Matsuda, Hitachi; Kiyotaka Ueda, Hitachi, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/600,317

(22) PCT Filed: Jan. 30, 1998

(86) PCT No.: PCT/JP98/00393

§ 371 (c)(1),
(2), (4) Date: Jul. 13, 2000

(87) PCT Pub. No.: WO99/39356

PCT Pub. Date: Aug. 5, 1999

(51) Int. Cl.[7] ..... F23B 5/00; F23G 7/06; F23G 5/10; F23J 15/00

(52) U.S. Cl. ..... 110/237; 110/211; 110/250; 110/345

(58) Field of Search ..... 110/211, 215, 110/235, 250, 342, 345, 346, 237; 588/201, 202, 203, 204, 209, 19, 1, 2, 3; 75/10.14, 10.36, 393, 394, 396, 398; 266/45, 144

(56) References Cited

U.S. PATENT DOCUMENTS

| | | | | | |
|---|---|---|---|---|---|
| 3,997,333 | A | * | 12/1976 | Fey | 75/11 |
| 4,346,661 | A | * | 8/1982 | Nakumura | 110/259 |
| 4,627,069 | A | * | 12/1986 | Harvey et al. | 373/29 |
| 4,760,585 | A | * | 7/1988 | Queiser et al. | 373/122 |
| 4,786,319 | A | * | 11/1988 | Zeiringer | 75/10.62 |
| 5,000,098 | A | * | 3/1991 | Ikeda et al. | 110/238 |
| 5,050,512 | A | * | 9/1991 | Tratz et al. | 110/346 |
| 5,054,405 | A | * | 10/1991 | Walker | 110/254 |
| 5,104,095 | A | * | 4/1992 | Elliot et al. | 266/87 |
| 5,170,728 | A | * | 12/1992 | Tanari | 110/346 |
| 5,202,100 | A | * | 4/1993 | Nagel et al. | 423/5 |
| 5,238,484 | A | * | 8/1993 | Pirklbauer et al. | 75/414 |
| 5,301,620 | A | * | 4/1994 | Nagel et al. | 110/346 |
| 5,304,701 | A | * | 4/1994 | Igarashi | 588/201 |

(List continued on next page.)

FOREIGN PATENT DOCUMENTS

| | | | | |
|---|---|---|---|---|
| GB | 2063438 A | * | 6/1981 | F23G/7/00 |
| JP | 56-64700 | | 6/1981 | |
| JP | 61-210998 | | 9/1986 | |
| JP | 1-288387 | | 11/1989 | |
| JP | 6-64192 | | 8/1994 | |
| JP | 8-82408 | | 3/1996 | |
| JP | 2503004 | | 3/1996 | |
| JP | 9-90096 | | 4/1997 | |
| JP | 9-112864 | | 5/1997 | |

OTHER PUBLICATIONS

"Research and Development on Processing and Disposal of Radioactive Wastes", (Sangyo Gijutsu Shuppan), p. 175.

*Primary Examiner*—Henry Bennett
*Assistant Examiner*—K. B. Rinehart
(74) *Attorney, Agent, or Firm*—Mattingly, Stanger & Malur, P.C.

(57) ABSTRACT

An incineration and melting furnace has a furnace main body that is filled with a conductive heat generation body (for example, graphite). Radioactive combustible materials in contact with the conductive heat generation body are burnt and the radiaoactive incombustible materials are melted. The resultant exhaust gases and the molten products flow downwardly in the conductive heat generation body filled region and flow out of a molten product discharging port. Noxious gases such as dioxins contained in the exhaust gases are thermally decomposed into a non-toxic state in a high temperature portion of the conductive heat generation region.

15 Claims, 3 Drawing Sheets

U.S. PATENT DOCUMENTS 5,443,572 A * 8/1995 Wilkinson et al. ..... 266/46
5,511,496 A * 4/1996 Schoener et al. ..... 110/346
5,640,709 A * 6/1997 Nagel et al. ..... 588/201
5,765,489 A * 6/1998 Hugentobler et al. ..... 110/344
5,785,923 A * 7/1998 Surma et al. ..... 266/144
5,866,095 A * 2/1999 McGeever et al. ..... 423/659
5,925,165 A * 7/1999 Pflugl et al. ..... 75/10.41
5,958,264 A * 9/1999 Tsantrizos et al. ..... 219/121.38
5,999,556 A * 12/1999 Haissig ..... 373/9
6,069,290 A * 5/2000 Wagner ..... 588/1
6,195,382 B1 * 2/2001 Wagner ..... 373/146

* cited by examiner

SOLID MATERIAL MELTING APPARATUS

TECHNICAL FIELD

The present invention relates to a solid material melting apparatus, and more particular, it relates to a solid material melting apparatus suitable to incineration and melting of radioactive solid wastes (including combustible materials, less combustible materials and incombustible materials) discharged from radioactive material handling facilitates such as nuclear power plants.

BACKGROUND ART

Combustible radioactive solid-wastes such as rags, clothing and plastics, such as vinyl chloride and incombustible radioactive solid wastes such as metal wastes and thermal insulation materials are discharged from radioactive material handling facilities such as nuclear power plants. The combustible materials and incombustible materials are separated, and incineration processing for the combustible materials and compression processing of wastes or melting processing of melting wastes at high temperature to reduce the volume for incombustible materials have been investigated. Further, for the residues and incineration ashes after incineration of the combustible materials, melting processing has been considered.

As an incineration furnace for processing combustible radioactive solid wastes, an apparatus described in "Research and Development on Processing and Disposal of Radioactive Wastes" (Sangyo Gijutsu Shuppan, p175) have been used generally. In this incineration furnace, combustible radioactive solid wastes are burnt by a gas burner inside of a furnace main body lined with refractories and exhaust gases are discharged from the upper portion of the furnace main body. The exhaust gases are removed with coarse particulates by ceramic filters and high performance filters provided in two stages, and then released out of the system. Further, residues and incineration ashes accumulated at the bottom of the furnace main body are discharged by opening a shutter at the bottom into drams and stored therein.

On the other hand, melting furnaces for processing incombustible solid wastes include two types, depending on the difference of the heating system, that is, a plasma heating type melting furnace and an induction heating type melting furnace. In the induction heating type melting furnace, alternating current is supplied to induction coils wound around a melting vessel, thereby generating radio frequency induced electromagnetic fields at several tens to several hundreds Hz in the melting vessel. Under the effect of the radio frequency induced electromagnetic fields, eddy current is generated to conductive materials disposed in the melting vessel. The solid wastes in a melting vessel are heated and melted by Joule heat caused by the eddy current.

An example of melting processing using such an induction heating type melting furnace is described in Japanese Publication of Patent Application No. Hei 6-64192. In the melting processing, an electroconductive ceramic container is heated by electromagnetic induction to melt solid wastes supplied into the ceramic container and then both the ceramic container and the solid wastes are taken out of the system together for making ingots by cooling.

Another melting processing by using the induction heating type melting furnaces is described in Japanese Patent Publication No. 2503004. In this melting processing, a conductive heat generation body made of carbon filled in the inside of the furnace main body heated by radio frequency magnetic fields and solid materials charged from above the filled layer of the conductive heat generation body are heated and melted by the heated conductive heat generation body. The molten solid materials flow down through gaps formed between each of the conductive heat generation bodies and are then discharged from the bottom of the furnace main body.

Among the prior arts described above, the incineration furnace for treating combustible solid wastes uses burners as a heat source, and so it is difficult to perform melting processing for incombustible solid wastes. Further, as for the handling of incineration ashes, it is necessary to take a countermeasure such as inhibition of scattering ashes.

Then, the melting processing described in Japanese Publication of Patent Application NO. Hei 6-64192 uses a conductive container based on carbon materials, so that it is not suitable to incineration processing of combustible materials in which combustion air is supplied. Further, since the melting processing is batchwise, it imposes a limit on the processing speed for the solid wastes.

The melting processing disclosed in Japanese Patent Publication No. 2503004 can additionally supply the carbon material for the heat generation body, and accordingly, it can also incinerate the combustible solid wastes in principle. Further, since the molten solid materials can be taken out continuously from the bottom of the furnace main body, the processing speed for the solid materials is increased. However, since the exhaust gases are discharged from the upper end of the furnace main body, soots, coarse particulates and combustion gases are exhausted as they are as gaseous wastes. This remarkably increases the burden on the exhaust gas processing. Further, since the solid materials are charged on the filled layer of the conductive heat generation body, dioxins and other noxious gases are generated by incomplete combustion of the solid materials, which may possibly be discharged from the upper end of the furnace main body together with exhaust gases without being decomposed. In addition, there is a possibility that air at low temperature is sucked from a discharging port at the bottom of the furnace to the inside of the furnace along with discharge of the exhaust gases to possibly lower the temperature at the discharging port. Since this may possibly coagulate molten products at the discharging port and clog the same, it is necessary to provide an auxiliary burner or the like.

An object of the present invention is to provide a solid material melting apparatus for suppressing formation of noxious gases such as dioxins and the likes without causing clogging at a discharging port.

DISCLOSURE OF INVENTION

A feature of the first invention for attaining the foregoing object resides in an apparatus for melting solid materials comprising a furnace main body having an opening/closing charging port for solid materials and a molten product discharging port at a lower end thereof, and being filled the inside thereof with a conductive heat generation body, and induction coils disposed at the periphery of the furnace main body for induction heating the conductive heat generation body, in which the solid materials supplied to the inside of the furnace main body are melted, characterized in that it comprises a combustion air supply means connected to an upper portion of the furnace main body and an exhaust gas discharging port disposed to a lower end of the furnace main body.

Since the combustion air supply means is connected to the upper portion of the furnace main body and the exhaust gas discharging port is disposed to the lower end of the furnace main body, combustion air is supplied to the upper portion of the furnace main body and exhaust gases generated by the combustion of combustible solid materials are discharged through gaps between each of the conductive heat generation bodies at a high temperature and then discharged from the exhaust gas discharging port at the lower end of the furnace main body to the outside of the furnace main body. Particularly, a portion below the upper end of the filled layer of the conductive heat generation body is at a high temperature. Accordingly, unburned gases and noxious gases contained in the exhaust gases are thermally decomposed while the exhaust gases pass through a high temperature region in the filled layer of the conductive heat generation body so as to promote non-toxification. Accordingly, the amount of dioxins contained in exhaust gases discharged from the exhaust gas discharging port is remarkably lowered and the amount of dioxins discharged to the external environment is also reduced remarkably.

As the conductive heat generation body, those materials being resistant to high temperature and having relatively low electrical resistance value are preferred, and specifically, carbonaceous materials such as graphite, coke, silicon carbide and titanium carbide, high melting metals such as tantalum, molybdenum and tungsten, boride ceramics such as zirconium boride, titanium boride, niobium boride and molybdenum boride, molybdenum zirconia and molybdenum silicide may be used preferably.

A feature of the second invention for attaining the foregoing object resides in that the molten product discharging port serves also as the exhaust gas discharging port.

Since the molten product discharging port serves also as the exhaust gas discharging port, the molten product discharging port is heated to a high temperature by exhaust gases. Accordingly, it is possible to avoid solidification of molten products by cooling the molten product discharging port and to avoid clogging at the molten product discharging port.

A feature of the third invention for attaining the foregoing object resides in the provision of a molten product discharging channel with air tight property connected to the molten product discharging port for introducing the molten products and the exhaust gases, an air tight chamber which is connected to the molten product discharging channel for delivery and entry of a container filled with the molten products flowing through the molten product discharging channel, and an exhaust gas discharging pipeline connected to the air tight chamber for discharging the exhaust gases introduced through the molten product discharging channel into the air tight chamber.

Since the air tight chamber for delivery and entry of the container filled with the molten products flowing through the molten product discharging channel and the exhaust gas discharging pipeline connected to the air tight chamber for discharging the exhaust gases introduced through the molten product discharging channel into the sealed chamber are provided, injection of the molten products into the container and separation of the exhaust gases from the molten products and the exhaust gases flowing in the molten product discharging channel are performed easily to thereby facilitate discharge of the exhaust gases to the outside.

A feature of the fourth invention for attaining the foregoing object resides in that the combustion air supply means comprises a check valve for inhibiting the back flow of the gases flowing in the furnace main body.

Since the check valve is provided, even when the combustion of the combustible solid materials is promoted by charging a great amount of the combustible solid materials into the furnace main body to abruptly increase the pressure in the furnace main body, back flow of the exhaust gases in the furnace main body through the combustion air supply means in the furnace main body can be prevented. Accordingly, the noxious gases contained in the exhaust gases are prevented from being discharged to the external environment without being thermally decomposed through the combustion air supply means.

A feature of the fifth invention for attaining the foregoing object resides in the provision of a heating means for heating the combustion air supplied from the combustion air supply means into the furnace main body by the exhaust gases discharged from the exhaust gas discharging port.

Since the combustion air supplied in the furnace main body is heated by the exhaust gases, the temperature of the combustion air to be supplied into the furnace main body can be elevated, thus promoting the combustion of the solid materials, particularly, combustible solid materials to improve the incinerating performance of the solid material melting apparatus. Since the heat possessed in the exhaust gases is used for heating the combustion air, there is no requirement for providing any additional heating means and therefore the thermal efficiency of the apparatus for melting solid materials is improved. In addition, the temperature of the exhaust gases can be lowered.

A feature of the sixth invention for attaining the foregoing object resides in the provision of a heating means for heating the combustion air supplied from the combustion air supply means into the furnace main body by the exhaust gases introduced by the exhaust gas discharging pipeline.

A feature of the sixth invention can provide the function and the effect obtained by the feature of the third invention, as well as the function and the effect obtained by the feature of the fifth invention.

A feature of the seventh invention for attaining the foregoing object resides in the provision of a filter for removing solid components contained in the exhaust gases discharged from the heating means.

Since the filter is disposed at the downstream of the heating means, exhaust gases at a lowered temperature are introduced to the filter. This can improve the service life of the filter.

A feature of the eighth invention for attaining the foregoing object reside in the provision of a combustion air supply means connected to an upper portion of the furnace main body and a coolant vessel filled with a coolant, the molten product discharging port serving also as a discharging port for exhaust gases, and further, provision of the molten product discharging channel with air tight property connected to the molten product discharging port for introducing the molten products into the coolant vessel, an exhaust gas discharging pipeline connected to the molten product discharging channel above the liquid surface in the coolant vessel for discharging the exhaust gases flowing in the molten product discharging channel and a means for taking out the coagulated molten products from the coolant in the coolant vessel.

According to the feature of the eighth invention, since the molten products are supplied into the coolant vessel filled with the coolant and the molten products coagulated in the coolant vessel are taken out of the coolant vessel, the molten products can be handled easily and can be taken out easily. Further, since the coolant in the coolant vessel constitute a liquid sealing mechanism to provide the effect of a buffer relative to abrupt increase of the pressure in the furnace main body, the safety of the furnace main body can be improved. Further, the feature of the eighth invention can also provide the function and the effect obtained by each of the features according to the first invention and the second invention.

A feature of the ninth invention for attaining the foregoing object resides in the provision of a heating means for heating the combustion air supplied from the combustion air supply means into the furnace main body by the exhaust gases introduced through the exhaust gas discharging pipelines as set forth in the eighth invention.

A feature of the ninth invention can provide the function and the effect obtained by the feature of the fifth invention in addition to the function and the effect obtained by the feature of the eighth invention.

A feature of the tenth invention for attaining the foregoing object resides in that the combustion air supply means in the eighth invention comprises a check valve for inhibiting the back flow of the gases flowing in the furnace main body.

The feature of the tenth invention can provide the function and the effect obtained by the feature of the fourth invention in addition to the function and the effect obtained by the feature of the eighth invention.

A feature of the eleventh invention for attaining the foregoing object resides in the provision of a combustion air supply means connected to an upper portion of the furnace main body and a molten product storage chamber with air tight property having a heating means, the molten product discharging port serving also as an exhaust gas discharging port, and further, provision of the molten product discharging channel with air tight property connected to the molten product discharging port for introducing the molten products into the molten product storage chamber and an exhaust gas discharging pipeline connected to the molten product storage chamber for discharging the exhaust gases introduced through the molten product discharging channel to the molten product storage chamber.

Since the molten product storage chamber with air tight property having the heating means is provided, the molten products discharged from the molten product discharging port of the furnace main body can be stored in the molten product store chamber. Therefore, there is no longer required to provide the air tight chamber for injecting the molten products in the vessel in the third invention, and the constitution of the solid material melting apparatus in the third invention can be simplified. since it is suffice to inject the molten products stored in the molten product storage chamber into the container, the molten product injection operation is facilitated as well.

A feature of the twelfth invention for attaining the foregoing object resides in the provision of a heating means for heating the combustion air supplied by the combustion air supply means into the furnace main body in the eleventh invention by the exhaust gas introduced through the exhaust gas discharging pipeline.

The feature of the twelfth invention can provide the function and the effect obtained by the feature of the eleventh invention, as well as the function and the effect obtained by the feature of the fifth invention.

The feature of the thirteenth invention for attaining the foregoing object resides in a solid material melting apparatus comprising a furnace main body having an opening/closing charging port for radioactive solid wastes and a molten product discharging port at a lower end thereof, and being filled at the inside thereof with a conductive heat generation body, and induction coils disposed at the periphery of the furnace main body for induction heating the conductive heat generation body, in which the radioactive solid wastes supplied to the inside of the furnace main body are melted, characterized by the provision of a combustion air supply means connected to an upper portion of the furnace main body, the molten product discharging port serving also as a discharging port for the exhaust gases, and further, provision of the molten product discharging channel with air tight property connected to the molten product discharging port for introducing the molten products and the exhaust gases thereto, an air tight chamber which is connected to the molten product discharging channel for delivery and entry of a container to be filled with the molten products flowing in the molten product discharging channel and an exhaust gas discharging pipeline connected to the air tight chamber for discharging the exhaust gases introduced through the molten product discharging channel into the air tight chamber.

Since the combustion air supply means is connected to the upper portion of the furnace main body and the exhaust gas discharging port is provided at the lower end of the furnace main body, the combustion air is supplied to the upper portion of the furnace main body and exhaust gases generated by the combustion of the combustible radioactive solid wastes are discharged through the gaps between each of the conductive heat generation bodies at a high temperature from the discharging port situated at the lower end to the outside of the furnace main body. Accordingly, since radioactive materials (for example, cesium) is transferred downwardly, being entrained by the flow of the exhaust gases, from the upper end of the conductive heat generation body filled layer, the degree of contamination on the inner wall of the furnace main body with the radioactive materials is lowered above the upper end of the conductive heat generation body filled layer. Accordingly, maintenance for the furnace main body above the upper end of the conductive heat generation body filled layer can be conducted easily.

BEST MODE FOR CARRYING OUT THE INVENTION

Embodiment 1

Figure 1:
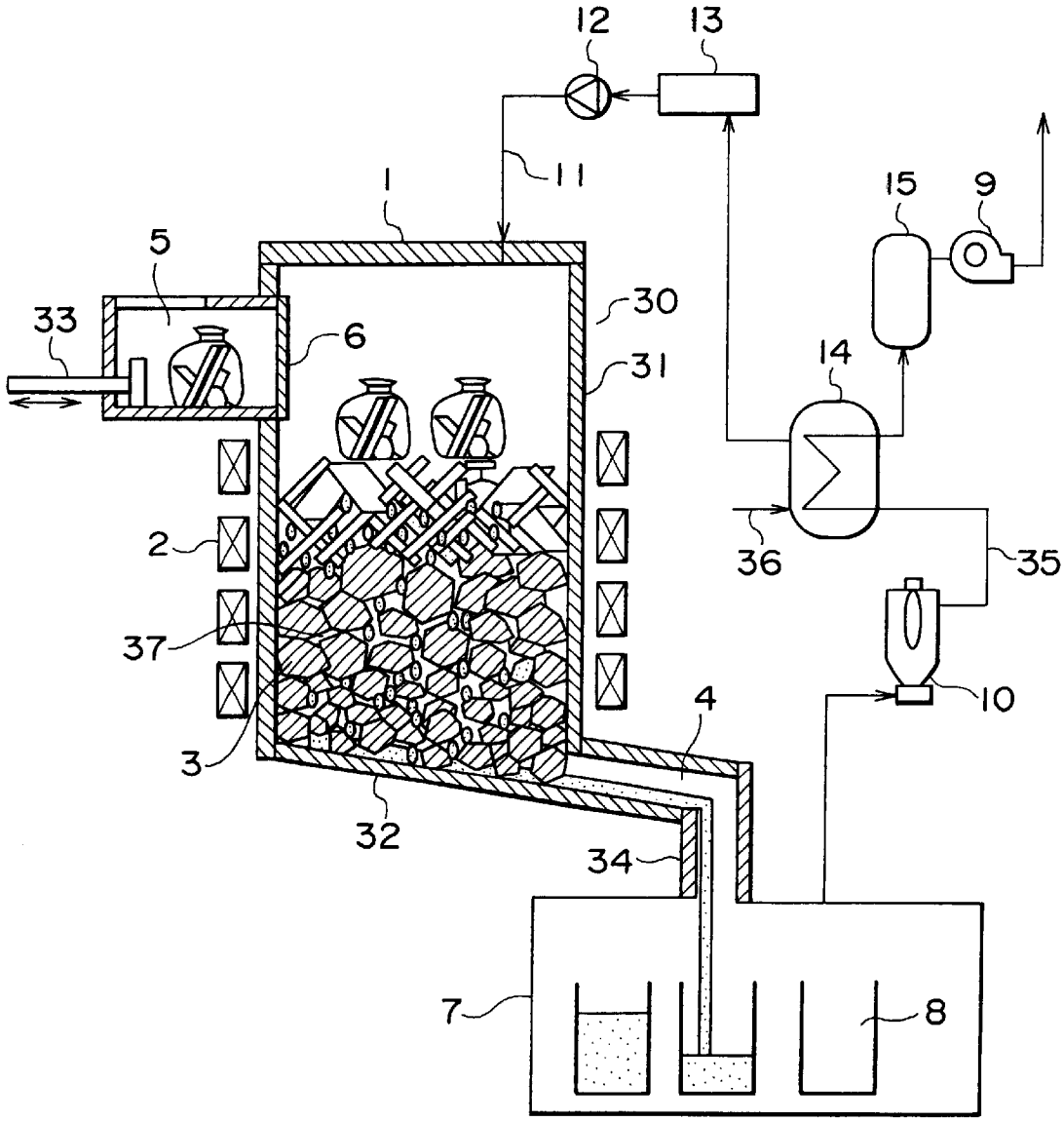
FIG. 1 is a constitutional view of an apparatus for melting solid materials as a preferred embodiment according to the present invention.

An apparatus for melting solid materials as a preferred embodiment according to the present invention is to be explained as below with reference to FIG. 1.

A solid material melting apparatus in this embodiment comprises an incineration and melting furnace 30, an air tight chamber 7, an inflammable gas combustion chamber 10, a heat exchanger 14, a coarse particulate filter 15 and a check valve 12. The incineration and melting furnace 30 comprises a furnace main body 1, spiral induction coils 2 disposed surrounding the periphery of the furnace main body 1, and a hopper 5 disposed on the upper end of the furnace main body 1 for charging solid materials. The furnace main body 1 has a cylindrical side wall 31 constituted with refractory materials, and a bottom 32 constituted with refractory materials and attached to the lower end of the side wall 31. A discharging port 4 is formed at the lower end of the side wall 31. The bottom 32 of the furnace main body 1 is inclined toward the discharging port 4 such that the molten products flow toward the discharging port 4. The hopper 5 is provided with a solid material charge device 33 and an opening/closing door 6. The conductive heat generation bodies 3 as lumpy graphite are stacked in the furnace main body 1.

The air tight chamber 7 is connected to a tubular molten product discharging channel 34 connected to the discharging port 4 in communication with the inside of the furnace main body 1. An exhaust gas discharging pipeline 35 is connected to the air tight chamber 7. An inflammable gas combustion chamber 10, heat conduction pipes disposed in the heat exchanger 14, a coarse particulate filter 15 and an exhaust device (for example, blower) 9 are disposed in this order in the exhaust gas discharging pipeline 35. A combustion air supply pipeline 11 is connected to the upper end of the furnace main body 1. The combustion air supply pipeline 11 is connected to the heat exchanger 14 on the shell side. An air compressor 13 and a check valve 12 are disposed in the combustion air supply pipeline 11 from the heat exchanger 14 on the shell side to the furnace main body 1. An air intake port 36 is connected to the heat exchanger 14 on the shell side.

When alternating current is supplied to the induction coils 2, radio frequency magnetic fields are formed in the induction coils 2. Accordingly, Joule heat is generated by eddy current in the conductive heat generation body 3 and the temperature of the conductive heat generation body 3 is elevated to a level sufficient to incinerate and melt the radioactive solid wastes.

The radioactive solid wastes as the solid materials to be charged in the hopper 5 are transferred by the movement of a solid material charging device 33 from the exit of the hopper 5 to the inside of the furnace main body 1. At that time, the radioactive solid wastes are transferred into the furnace main body 1, by pushing to open the opening/closing door 6 inwardly. When the supply of the radioactive solid wastes is completed, the opening/closing door 6 returns to the home position to seal the exit of the hopper 5. When the opening/closing door 6 is pushed to open inwardly, external air flows into from the exit of the hopper 5 into the furnace main body 1. However, when the opening/closing door 6 is closed, noxious gases in the furnace main body 1 are not flown out through the hopper 5 to the outside.

The radioactive solid wastes include combustible radioactive solid wastes such as paper, rag, clothing and plastic materials and incombustible radioactive solid wastes such as metal wastes and thermal insulation materials, those generated from the radioactive material handling facility such as nuclear power plants. Such radioactive wastes are supplied alone, or in admixture of a plurality of them (including the case where all of the wastes are mixed together) into the furnace main body 1. In some cases, ion exchange resins and waste sludges as combustible radioactive solid wastes are also supplied into the furnace main body 1.

The radioactive solid wastes supplied into the furnace main body 1 are stacked on the filled region of the conductive heat generation body 3. Combustion air flown from the air intake port 36 by driving the air compressor 13 is supplied by way of the heat exchanger 14 on the shell side and the combustion air supply pipeline 11 to a space above the filled region of the conductive heat generation body 3 in the furnace main body 1. The radioactive solid wastes on the filled region of the conductive heat generation body 3 are heated by the radiation heat and heat conducted from the conductive heat generation body 3 generating Joule heat. Among the radioactive solid wastes, combustible radioactive solid wastes (hereinafter referred to as radioactive combustible materials) are incinerated under the presence of the combustion air to form incineration ashes. The incineration ashes are further melted by the heat from the conductive heat generation body 3 and flow down through the gap 37 formed between each of the conductive heat generation bodies 3. On the other hand, incombustible radioactive solid wastes (hereinafter referred to as radioactive incombustible materials) are burnt and also melted (melted in the same manner as the incineration ashes) and flow down through the gaps 37. The molten products are discharged from the discharging port 4 of the furnace main body 1 and then injected through the molten product discharging channel 34 into the containers 8 disposed in plurality in the air tight chamber 7 successively. The containers 8 are transferred below the molten product discharging channel 34 by a transfer device such as a conveyor (not shown) disposed in the air tight chamber 7.

The incineration and melting furnace 30 operates during daytime to incinerate and melt the radioactive solid wastes and stops incineration and melting during night. Molten products discharged from the incinerating and melting furnace 30 by incineration and melting operation for one day can be contained in several containers. Therefore, after completion of incineration and melting for one day, the containers 8 filled with the molten products are taken out of the air tight chamber 7 to the outside by opening an air tight door (not shown) of the air tight chamber 7 and then transferred to a storing site not shown. The molten products in the containers 8 are spontaneously cooled and the containers 8 containing the molten products therein are formed into ingot solidification products. After delivery of the containers 8 filled with the molten product, several containers 8 to be injected with molten products in the following day are delivered from the air tight door into the air tight chamber 7 and loaded on the transfer device. Then, the air tight door is closed.

Exhaust gases evolved by the combustion of the radioactive combustible materials are discharged through the gap 37 between each of the conductive heat generation bodies 3 at high temperature and through the discharging port 4 and the molten product discharging channel 34 into the air tight chamber 7. Noxious gases are generated due to the combustion of radioactive combustible materials. Particularly, noxious gases such as dioxins are generated due to the combustion of plastics such as vinyl chloride. This noxious gases are contained in the exhaust gases. In a steady state, the temperature in the conductive heat generation body filled region is about at 1,550° C. at the upper end in contact with the radioactive wastes, at about 1,600 to 1,700° C. in a central area along the direction of the height and at about 1,800° C. at the lower end. Noxious gases such as dioxins contained in the exhaust gases are thermally decomposed while the exhaust gases pass through the gaps 37 in a high temperature region which is below the upper end of the conductive heat generation body filled region. Further, unburned gases generated by combustion of the radioactive combustible materials and contained in the exhaust gases are also thermally decomposed during passage through the conductive heat generation body filled region. As described above, the noxious gases and the unburned gases are thermally decomposed into a non-toxic state. The region below the upper end of the conductive heat generation body filled region is a decomposition region of the noxious gases such as dioxins and unburned gases.

When carbonaceous material such as graphite and coke is used as the conductive heat generation body 3, the conductive heat generation body 3 is consumed by combustion of the conductive heat generation body 3 itself. Therefore, the conductive heat generation body 3 is supplemented optionally by the hopper 5 into the furnace main body 1.

The exhaust gases discharged to the air tight chamber 7 flow into the exhaust gas discharging pipeline 35 by driving the discharge device 9. The exhaust gases are passed through the inflammable gas combustion chamber 10, the heat transfer tubes in the heat exchanger 14, the coarse particulate filter 15, the discharge device 9 and an activated carbon adsorption column (not shown) successively by the exhaust gas discharging pipe channel 35 and then discharged through an exhaust cylinder, not shown, to the external environment. The air tight chamber 7 is always kept at a negative pressure by driving the exhaust device 9. Therefore, the inside of the furnace main body 1 connected by way of the molten product discharging channel 34 and the discharging port 4 to the air tight chamber 7 is also kept at a negative pressure. Accordingly, radioactive materials can be prevented from leaking from the furnace main body 1 and the air tight chamber 7 to the outside.

Since graphite as the carbonaceous material is used for the conductive heat generation body 3, the conductive heat generation body filled region becomes a reducing atmosphere. Therefore, carbon monoxide and hydrocarbons are generated in the reducing atmosphere. A part of them are discharged together with the exhaust gases from the furnace main body 1 as it is without being thermally decomposed in the conductive heat generation body filled region. Carbon monoxide and hydrocarbons contained in the exhaust gases are burnt in the inflammable gas combustion chamber 10 by igniting an auxiliary combustion burner (not shown). In this way, exhaust gases are purified. Further, other inflammable gases contained in the exhaust gases are also burnt therein. Exhaust gases discharged to the external environment do not contain carbon monoxide, hydrocarbons and other inflammable gases.

Also in a case of using other carbonaceous material than graphite such as coke as the conductive heat generation body 3, since the carbon monoxide and hydrocarbons are generated in the reducing atmosphere of the conductive heat generation body filled region, it is necessary to provide the inflammable gas combustion chamber 10.

Exhaust gases flowing out of the inflammable gases combustion chamber 10 are introduced into the heat transfer tubes of the heat exchanger 14. In the heat exchanger 14, exhaust gases heat a combustion air flowing through the heat exchanger 14 on the shell side. Combustion air heated up to a temperature of about 500° C. is supplied into the furnace main body 1. The exhaust gases discharged from the heat transfer tubes of the heat exchanger 14 are introduced into the coarse particulate filter 15. Since the temperature of the exhaust gases discharged from the heat transfer tubes of the heat exchanger 14 is lowered, the service life of the coarse particulate filter 15 is improved and the thermal load on the exhaust device 9 can be reduced. The temperature of the exhaust gases discharged from the heat exchanger 14 is 600 to 700° C.

Since combustion air heated in the heat exchanger 14 is supplied to the furnace main body 1, the degree that the furnace main body is cooled by the combustion air is decreased. Combustion of the radioactive combustible materials can be promoted, the incineration performance of the incineration and melting furnace 30 can be improved and the thermal efficiency of the incineration melting furnace 30 is also enhanced. Further, since the radioactive incombustible materials are also heated by the combustion air, this promotes melting to start. Therefore, the melting performance of the incineration and melting furnace 30 is also improved. Since the heat possessed in the exhaust gases is used for the heating of the combustion air, there is no requirement for installing any additional heating device such as an electric heater, and thus energy utilization factor of the solid material melting apparatus is improved.

The coarse particulate filter 15 removes coarse particulates contained in the exhaust gases. As a matter of fact, the radioactive coarse particulates are removed therein. The activated carbon adsorption column adsorbs and removes radioactive gases contained in the exhaust gases.

According to this embodiment, since the combustion air is supplied to a space in the upper portion of the furnace main body 1, namely, to a space above the conductive heat generation body filled region, the radioactive combustible materials can be burnt in this space. Further, the incineration residues and incineration ashes are melted in contact with the conductive heat generation body 3 and flow down through the gap 37 and are discharged from the discharging port 4. Therefore, handling of the incineration ashes is no longer required and scattering of the incineration ashes can be prevented. Flying ashes, soots and coarse particulates are also melted in contact with the conductive heat generation body 3 and removed. Since the amount of the coarse particulates in the exhaust gases is remarkably decreased, loads on the coarse particulate filter 15 can be decreased remarkably. Use of the coarse particulate filter 15 with a small coarse particulate coarse particulate removal capacity is enabled.

According to this embodiment, since the combustion air is supplied to the upper portion of the furnace main body 1 and the exhaust gases are discharged from the discharging port 4 disposed near the bottom 32, the exhaust gases flow downwardly from the upper portion in the conductive heat generation body filled region. Accordingly, unburned gases and noxious gases contained in the exhaust gases are thermally decomposed while the exhaust gases pass through the high temperature region (region below the upper end) of the conductive heat generation body filled region and promoted for non-toxification. Therefore, the amount of dioxins contained in the exhaust gases discharged from the discharging port 4 is remarkably decreased and the amount of dioxins discharged to the external environment is reduced remarkably. Further, since the flow of the molten products and the flow of the exhaust gases in the gap 37 formed between each of the conductive heat generation bodies 3 are in parallel with each other, the flow of the molten products can be promoted in the gaps 37.

According to this embodiment, since radioactive materials (for example, cesium and the likes) are transferred downwardly from the upper end in the conductive heat generation body filled region being entrained on the flow of the exhaust gases, the degree of contamination on the inner wall of the furnace main body 1 with the radioactive materials is lowered above the upper end of the conductive heat generation body filled region. Accordingly, maintenance for the furnace main body 1 above the upper end of the conductive heat generation body filled region can be conducted easily.

In this embodiment, since the discharging port 4 functions also as an exhaust gas discharging port, the discharging port 4 is heated to a high temperature by the exhaust gases. Therefore, this can prevent the molten products from being solidified to clog the discharging port 4 by cooling the discharging port 4.

Since this embodiment has the air tight chamber 7, the molten products can be injected safely into the containers 8 without scattering the powdery radioactive dusts caused by the exhaust gases to the external environment. Since the exhaust gas discharging pipeline 35 is connected to the air tight chamber 7, exhaust gases can be separated easily from the molten products and the exhaust gases flowing in the molten product discharging channel 34, and the exhaust gases can be discharged easily to the outside.

Since this embodiment has the check valve 12, this can prevent the back flow of the exhaust gases in the furnace main body 1 through the combustion air supply pipeline 11, even in a case where combustion of the radioactive combustible materials is promoted to abruptly increase the pressure in the furnace main body 1 by charging a great amount of radioactive combustible materials into the furnace main body 1. Therefore, this can prevent noxious gases not being thermally decomposed contained in the exhaust gases from discharging from the air inlet port 36 to the external environment.

Since the coarse particulate filter 15 is disposed downstream to the heat exchanger 14, exhaust gases at lowered temperature are introduced to the coarse particulate filter 15. Accordingly, the service life of the coarse particulate filter 15 is extended.

Since radioactive wastes can be charged continuously in the furnace main body 1 and the resultant molten products can be discharged continuously, this embodiment has an advantage in that the volume of the incineration and melting furnace can be decreased and the processing speed for treating the radioactive wastes can be increased compared with the batchwise processing in which intermittent charge of the radioactive wastes and discharge of the molten products are carried out.

The solid material melting apparatus of this embodiment is further applicable, in addition to the radioactive wastes, to the processing for treating medical wastes including metal wastes such as injection needles, infectious wastes and discarded animal body.

When an conductive heat generation body constituted with materials other than the carbonaceous material is used as the conductive heat generation body 3, since the conductive heat generation body is not consumed, supplement of the conductive heat generation body into the furnace main body 1 is no longer required.

Embodiment 2

Figure 2:
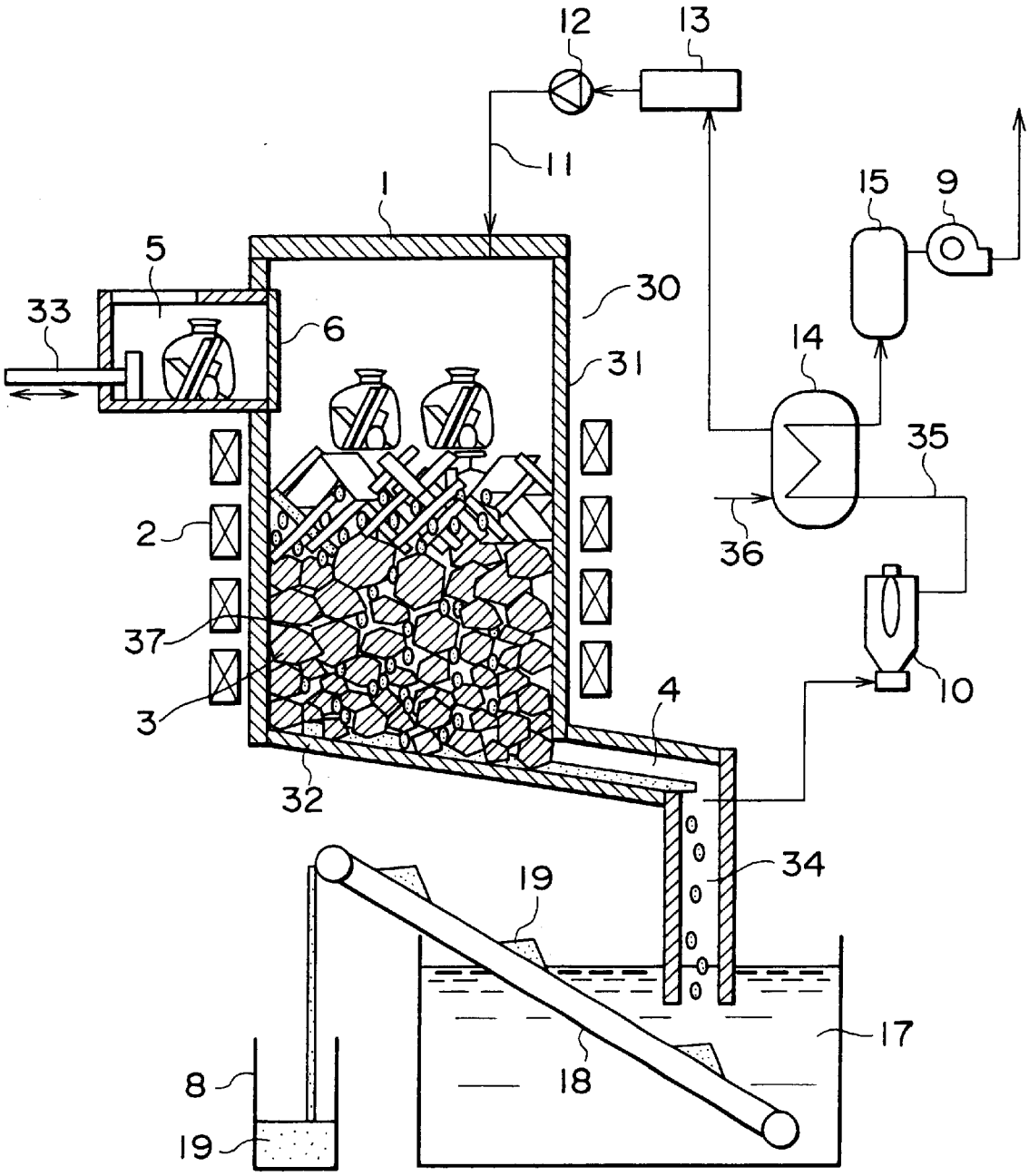
FIG. 2 is a constitutional view of an apparatus for melting solid materials as another embodiment according to the present invention.

A solid material melting apparatus as another embodiment of the present invention is to be explained below with reference to FIG. 2. Explanation is to be made, particularly, to portions different from the constitution of Embodiment 1.

This embodiment has a water vessel 17 filled with water. A molten product discharging channel 34 is inserted into water of the water vessel 17. A conveyor 18 is disposed in the water vessel 17. An exhaust gas discharging pipeline 35 is connected to the molten product discharging channel 34. Exhaust gases discharged from a discharging port 4 flow from the molten products discharging channel 34 to the exhaust gas discharging pipeline 35. On the other hand, the molten products discharged from the discharging port 4 are discharged passing through the molten product discharging channel 34 into water of the water vessel 17. The molten products are rapidly cooled for solidification in water of the water vessel 17 and turned into granules 19. The granules 19 are fallen on the driving conveyor 18 and carried out of the water vessel 17. The granules 19 are then filled in a container 8 outside of the water vessel 17.

The molten product discharge end of the molten product discharging channel 34 is sealed with water of the water vessel 17. The water vessel 17 has a function of efficiently exhausting the exhaust gases in the furnace main body 1 by inhibiting external air from flowing into the exhaust gas.

This embodiment can attain the effects derived from Embodiment 1 except for the effect obtained by disposing the air tight chamber 7. In this embodiment, since the molten products are coagulated into the granules 19 in the water vessel 17 and the granules 19 are taken out by the conveyor 18 from the water vessel 17, the molten products can be handled easily and the molten products discharged from the furnace main body 1 can be filled extremely easily into the container 8. Further, since water in the water vessel 7 provides a water sealing mechanism, which exhibits the effect as a buffer against abrupt increase of the pressure in the furnace main body 1, the safety of furnace main body 1 is improved.

Further, since the exhaust gas discharging pipeline 35 is connected to the molten product discharging channel 34 in this embodiment, exhaust gases can be separated easily from the molten products and exhaust gases flowing in the molten product discharging channel 34 and thus the exhaust gases can be discharged easily to the outside.

Embodiment 3

Figure 3:
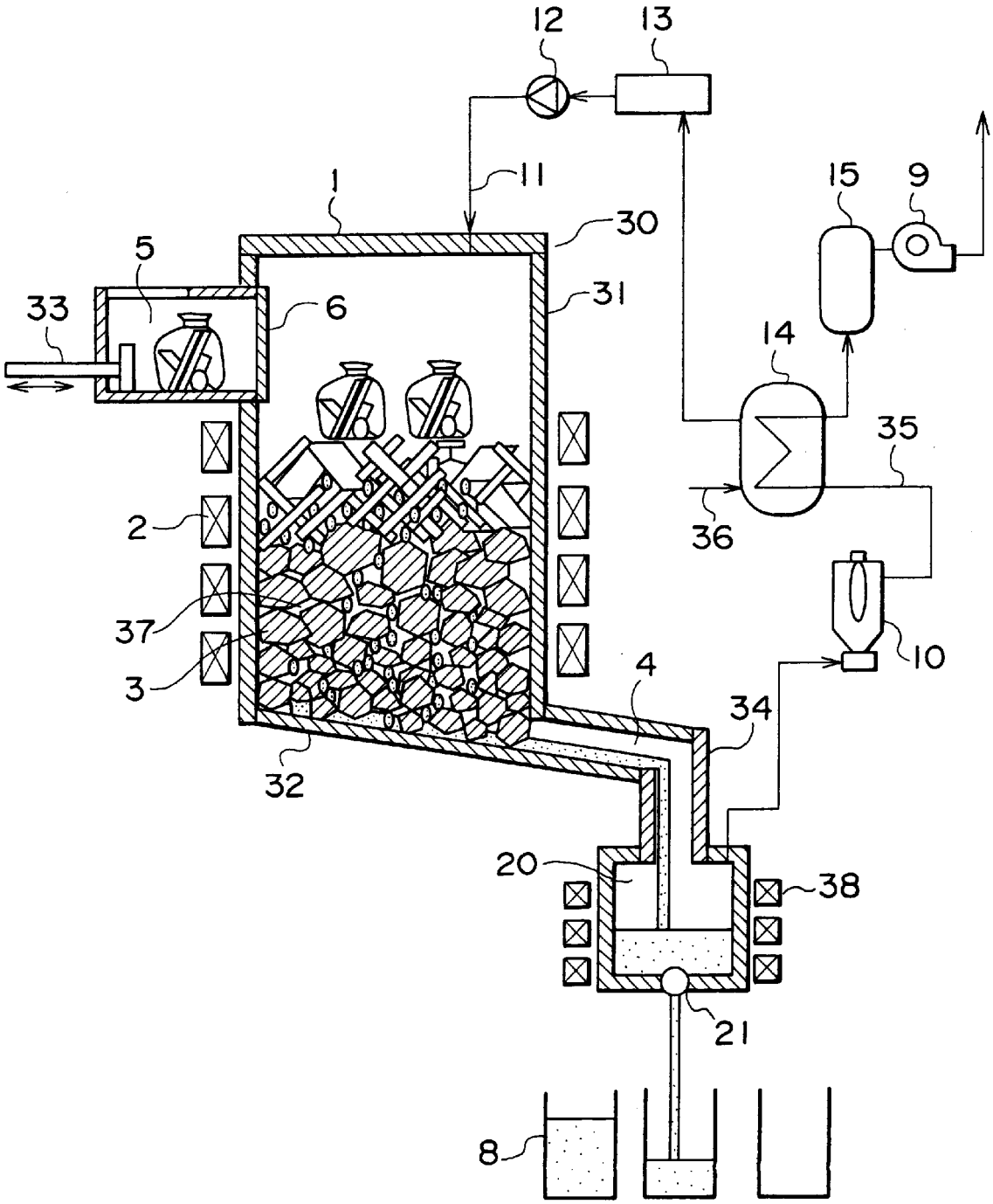
FIG. 3 is a constitutional view of an apparatus for melting solid materials as a further embodiment according to the present invention.

A solid material melting apparatus in a further embodiment according to the present invention is to be explained below with reference to FIG. 3. Explanation is to be made particularly to the portions different from the constitution of Embodiment 1.

In this embodiment, a molten product storage chamber 20 is disposed in place of the air tight chamber 7 in Embodiment 1. Induction coils 38 are arranged surrounding the periphery of the molten product storage chamber 20. A molten product discharging port is disposed at the bottom of the molten product storage chamber 20, to which an opening/closing device (for example, opening/closing valve) 21 is provided. An exhaust gas discharging pipeline 35 is connected to the molten product storage chamber 20.

Exhaust gases and molten products discharged from the furnace main body 1 to the discharging port 4 are introduced through the molten product discharging channel 34 into the molten product storage chamber 20. Exhaust gases are passed through an exhaust gas discharging pipeline 35, purified and then discharged from an exhaust cylinder (not shown) to the external environment. The molten products are kept in a liquid form in the molten product storage chamber 20 by induction heating of the induction coils 38. When the opening/closing device 21 is open, the molten products are injected into containers 8 situated below the opening/closing device 21. The molten products in the molten product storage chamber 20 are kept in the liquid form while they are temporarily stored in the molten product storage chamber 20 until they are injected into the container 8 by being heated by the induction coils 38.

The molten products accumulated in the molten product storage chamber 20 act as a seal, when the opening/closing device 21 is open, for inhibiting the external air from flowing into the molten product storage chamber 20 from the molten product discharging port at the bottom of the molten product storage chamber 20. This enables to conduct injection operation of the molten products into the container 8 in an open space. Besides, handling operation for the container 8 and ingot solidification products obtained by solidifying the molten products is facilitated. Further, since the molten products are discharged from the opening/closing device 21, control for the injection speed and ON/OFF control of the injection of the molten products are facilitated. There is no requirement of disposing the air tight chamber 7 as in Embodiment 1 for injecting the molten products into the container 8, and the constitution of the solid material melting apparatus can be simplified.

In order that the molten products accumulated in the molten product storage chamber 20 prevent flow of the external air to the exhaust gases and the exhaust gases in the furnace main body 1 are discharged efficiently, the molten product discharging port is desirably disposed at the bottom of the molten product storage chamber 20.

What is claimed is:

1. A solid material melting apparatus comprising:

a furnace main body having an opening/closing charging port adapted for feeding solid materials therethrough and a molten product discharging port formed at a lower end of the furnace main body;

conductive heat generation bodies stacked in said furnace main body;

an induction coil disposed outside of said furnace main body and heating inductively said conductive heat generation bodies;

combustion air supply means connected to an upper portion of said furnace main body; and an exhaust gas discharging port disposed at said lower end of said furnace main body.

2. A solid material melting apparatus comprising:

a furnace main body having an opening/closing charging port adapted for feeding solid materials therethrough, and a molten product discharging port formed at a lower end portion of the furnace main body;

conductive heat generation bodies stacked in said furnace main body;

an induction coil disposed outside of said furnace main body and heating inductively said conductive heat generation bodies;

said furnace main body having a decomposition region for resultant noxious gases formed therein, to which said molten products flow down; and an exhaust gas discharging port disposed at said lower end portion of said furnace main body, adapted for discharging therethrough exhaust gas generated by combustion of combustible materials included in said solid materials.

3. A solid material melting apparatus comprising:

a furnace main body having an opening/closing charging port adapted for feeding solid materials therethrough, and a molten product discharging port formed at a lower end portion of the furnace main body;

conductive heat generation bodies stacked in said furnace main body;

an induction coil disposed outside of said furnace main body and heating inductively said conductive heat generation bodies;

said furnace main body having a decomposition region for the hydrocarbons of large molecular weight to form a material of high viscosity by coagulation formed therein in which the molten products flow down; and an exhaust gas discharging port disposed at a lower end portion of said furnace main body, and adapted for discharging therethrough exhaust gases generated by combustion of combustible materials included in said solid materials.

4. A solid material melting apparatus comprising:

a furnace main body having an opening/closing charging port adapted for feeding solid materials therethrough, and a molten product discharging port formed at a lower end portion of the furnace main body;

conductive heat generation bodies stacked in said furnace main body;

an induction coil disposed outside of said furnace main body and heating inductively said conductive heat generation bodies; and combustion air supply means connected to an upper portion of said furnace main body;

said molten product discharging port also adapted as a discharging port for discharging therethrough exhaust gases generated by combustion of combustible materials included in said solid materials.

5. A solid material melting apparatus according to claim 4, further comprising:

a molten product discharging channel connected airtightly to the molten product discharging port for introducing the molten product and the exhaust gases;

an airtight chamber which is connected to said molten product discharging channel for delivery and entry of a container filled with said molten product flowing through said molten product discharging channel; and an exhaust gas discharging pipeline connected to the airtight chamber for discharging said exhaust gases introduced through said molten product discharging channel into the airtight chamber.

6. A solid material melting apparatus according to claim 1, wherein said combustion air supply means has a check valve for inhibiting the back flow of a gas from the furnace main body.

7. A solid material melting apparatus according to claim 1, further comprising:

heating means for heating the combustion air supplied from said combustion air supply means into said furnace main body by said exhaust gases discharged from said exhaust gas discharging port.

8. A solid material melting apparatus according to claim 5, further comprising:

heating means for heating the combustion air supplied from said combustion air supply means into said furnace main body by said exhaust gases introduced by said exhaust gas discharging pipeline.

9. A solid material melting apparatus according to claim 7, further comprising a filter for removing solid contents contained in said exhaust gases discharged from said heating means.

10. A solid material melting apparatus comprising:

a furnace main body having an opening/closing charging port adapted for feeding solid materials therethrough, and a molten product discharging port formed at a lower end of the furnace main body;

conductive heat generation bodies stacked in said furnace main body;

an induction coil disposed outside of said furnace main body and heating inductively said conductive heat generation bodies;

combustion air supply means connected to an upper portion of said furnace main body and a coolant vessel filled with a coolant;

said molten product discharging port adapted also as an exhaust gas discharging port for discharging exhaust gases therethrough;

an airtight molten product discharging channel connected to said molten product discharging port for introducing said molten products into the coolant vessel;

an exhaust gas discharging pipeline connected to said molten product discharging channel above a liquid surface in said coolant vessel for discharging said exhaust gases flowing in said molten product discharging channel; and means for taking out coagulated molten products from the coolant in said coolant vessel.

11. A solid material melting apparatus according to claim 10, further comprising:

heating means for heating combustion air supplied from said combustion air supply means into said furnace main body by the exhaust gases introduced by said exhaust gas discharging pipeline.

12. A solid material melting apparatus according to claim 10, said combustion air supply means having a check valve for inhibiting the back flow of a gas from the furnace main body.

13. A solid material melting apparatus comprising:

a furnace main body having an opening/closing charging port adapted for feeding solid materials therethrough, and a molten product discharging port formed at a lower end of the furnace main body;

conductive heat generation bodies stacked in said furnace main body;

an induction coil disposed outside of said furnace main body and heating inductively said conductive heat generation bodies;

combustion air supply means connected to an upper portion of said furnace main body and an airtight molten product storage chamber;

said molten product discharging port adapted also as an exhaust gas discharging port for discharging exhaust gases therethrough;

an airtight molten product discharging channel connected to said molten product discharging port for introducing said molten products into the molten product storage chamber; and an exhaust gas discharging pipeline connected to said molten product storage chamber for discharging said exhaust gases introduced through said molten product discharging channel to said molten product storage chamber.

14. A solid material melting apparatus according to claim 10, further comprising:

heating means for heating the combustion air supplied from said combustion air supply means into said furnace main body by said exhaust gases introduced by said exhaust gas discharging pipeline.

15. A solid material melting apparatus comprising:

a furnace main body having an opening/closing charging port adapted for feeding radioactive solid materials therethrough, and a molten product discharging port formed at a lower end of the furnace main body;

conductive heat generation bodies stacked in said furnace main body;

an induction coil disposed outside of said furnace main body and heating inductively said conductive heat generation bodies;

combustion air supply means connected to an upper portion of the furnace main body;

the molten product discharging port adapted also as a discharging port for discharging the exhaust gases therethrough;

an airtight molten product discharging channel connected to said molten product discharging port for introducing said molten products and said exhaust gases;

an airtight chamber which is connected to said molten product discharging channel for delivery and entry of a container filled with said molten products flowing into said molten product discharging channel; and an exhaust gas discharging pipeline connected to said airtight chamber for discharging said exhaust gas introduced through said molten product discharging channel into said airtight chamber.

* * * * *